US010129622B2

(12) United States Patent
Baumhauer, Jr. et al.

(10) Patent No.: US 10,129,622 B2
(45) Date of Patent: Nov. 13, 2018

(54) GRADIENT MICRO-ELECTRO-MECHANICAL SYSTEMS (MEMS) MICROPHONE

(71) Applicant: HARMAN INTERNATIONAL INDUSTRIES, INC., Stamford, CT (US)

(72) Inventors: John C Baumhauer, Jr., Indianapolis, IN (US); Fengyuan Li, Carmel, IN (US); Larry A. Marcus, Fishers, IN (US); Alan D. Michel, Carmel, IN (US); Marc Reese, Indianapolis, IN (US)

(73) Assignee: Harman International Industries, Incorporated, Stamford, CT (US)

( * ) Notice: Subject to any disclaimer, the term of this patent is extended or adjusted under 35 U.S.C. 154(b) by 249 days.

(21) Appl. No.: 14/147,194

(22) Filed: Jan. 3, 2014

(65) Prior Publication Data

US 2015/0010191 A1 Jan. 8, 2015

Related U.S. Application Data

(60) Provisional application No. 61/842,858, filed on Jul. 3, 2013.

(51) Int. Cl.
*H04R 1/04* (2006.01)
*H04R 19/00* (2006.01)
(Continued)

(52) U.S. Cl.
CPC ..... *H04R 1/04* (2013.01); *H04R 19/005* (2013.01); *H04R 19/04* (2013.01); *H04R 1/38* (2013.01); *H04R 31/00* (2013.01)

(58) Field of Classification Search
CPC ..... H04R 19/005; H04R 19/04; H04R 1/38; H04R 31/00; H04R 1/04; H04R 1/021; H04R 1/406; H04R 3/005; B81C 1/0023
(Continued)

(56) References Cited

U.S. PATENT DOCUMENTS 5,226,076 A 7/1993 Baumhauer, Jr. et al.
7,110,553 B1 * 9/2006 Julstrom ..... H04R 3/005 381/356

(Continued)

FOREIGN PATENT DOCUMENTS

CN 102113345 A 6/2011
CN 102740206 A 10/2012
CN 102934464 A 2/2013

OTHER PUBLICATIONS

Extended European Search Report for corresponding Application No. 14175485.3, dated Dec. 1, 2014, 7 pages.

(Continued)

*Primary Examiner* — Fan Tsang
*Assistant Examiner* — Angelica M McKinney
(74) *Attorney, Agent, or Firm* — Brooks Kushman P.C.

(57) ABSTRACT

In at least one embodiment, a micro-electro-mechanical systems (MEMS) microphone assembly is provided. The assembly includes an enclosure, a MEMS transducer, and a plurality of substrate layers. The single MEMS transducer is positioned within the enclosure. The plurality of substrate layers support the single MEMS transducer. The plurality of substrate layers define a first transmission mechanism to enable a first side of the single MEMS transducer to receive an audio input signal and a second transmission mechanism to enable a second side of the single MEMS transducer to receive the audio input signal.

31 Claims, 12 Drawing Sheets

(51) Int. Cl.
*H04R 19/04* (2006.01)
*H04R 1/38* (2006.01)
*H04R 31/00* (2006.01)

(58) Field of Classification Search
USPC ..... 381/355, 174; 438/51; 257/416, 415; 29/594
See application file for complete search history.

(56) References Cited

U.S. PATENT DOCUMENTS 7,439,616 B2 10/2008 Minervini
8,073,179 B2 12/2011 Wu et al.
8,184,845 B2 5/2012 Leidl et al.
8,351,625 B2 1/2013 Kasai
8,351,634 B2 1/2013 Khenkin
8,804,982 B2 * 8/2014 Michel ..... H04R 1/406 381/111
8,824,719 B2 9/2014 Tanaka et al.
2007/0013036 A1 * 1/2007 Zhe ..... B81C 1/0023 257/659
2010/0142743 A1 * 6/2010 Tanaka ..... H04R 1/04 381/346
2010/0202649 A1 8/2010 Inoda et al.
2011/0176698 A1 * 7/2011 Tanaka ..... H04R 1/38 381/355
2012/0250897 A1 * 10/2012 Michel ..... H04R 1/406 381/111
2012/0257777 A1 10/2012 Tanaka et al.
2012/0300969 A1 11/2012 Tanaka et al.
2013/0070951 A1 * 3/2013 Tanaka ..... H04R 1/38 381/361
2013/0136291 A1 5/2013 Lee et al.
2014/0001580 A1 * 1/2014 Bolognia ..... B81C 1/00333 257/416

OTHER PUBLICATIONS

European Office Action for corresponding Application No. 14 175 485.3, dated Aug. 7, 2015, 6 pages.
European Search Report for Application No. 15173232.8, dated Oct. 30, 2015, 6 pages.
U.S. Non-Final Office Action for U.S. Appl. No. 14/323,595, dated Sep. 24, 2015, 7 pages.
U.S. Final Office Action for U.S. Appl. No. 14/323,595, dated May 11, 2016, 10 pages.
European Office Action for corresponding Application No. 14175485.3, dated Mar. 30, 2016, 5 pages.

* cited by examiner

GRADIENT MICRO-ELECTRO-MECHANICAL SYSTEMS (MEMS) MICROPHONE

CROSS-REFERENCE TO RELATED APPLICATIONS

This application claims the benefit of U.S. provisional Application No. 61/842,858 filed on Jul. 3, 2013, the disclosure of which is incorporated in its entirety by reference herein.

TECHNICAL FIELD

Aspects as disclosed herein generally relate to a microphone such as a gradient based micro-electro-mechanical systems (MEMS) microphone for forming a directional and noise canceling microphone.

BACKGROUND

A dual cell MEMS assembly is set forth in U.S. Publication No. 2012/0250897 (the '897 publication") to Michel et al. The '897 publication discloses, among other things, a transducer assembly that utilizes at least two MEMS transducers. The transducer assembly defines either an omnidirectional or directional microphone. In addition to at least first and second MEMS transducers, the assembly includes a signal processing circuit electrically connected to the MEMS transducers, a plurality of terminal pads electrically connected to the signal processing circuit, and a transducer enclosure housing the first and second MEMS transducers. The MEMS transducers may be electrically connected to the signal processing circuit using either wire bonds or a flip-chip design. The signal processing circuit may be comprised of either a discrete circuit or an integrated circuit. The first and second MEMS transducers may be electrically connected in series or in parallel to the signal processing circuit. The first and second MEMS transducers may be acoustically coupled in series or in parallel.

SUMMARY

In at least one embodiment, a micro-electro-mechanical systems (MEMS) microphone assembly is provided. The assembly includes an enclosure, a MEMS transducer, and a plurality of substrate layers. The single MEMS transducer is positioned within the enclosure. The plurality of substrate layers support the single MEMS transducer. The plurality of substrate layers define a first transmission mechanism to enable a first side of the single MEMS transducer to receive an audio input signal and a second transmission mechanism to enable a second side of the single MEMS transducer to receive the audio input signal.

In at least another embodiment, a MEMS microphone assembly is provided. The assembly includes an enclosure, a MEMS transducer, and a plurality of substrate layers. The single MEMS transducer is positioned within the enclosure. The plurality of substrate layers include a first substrate layer to support the single MEMS transducer. The first substrate layer is configured to electrically couple the single MEMS transducer to an end user circuit board. The plurality of substrate layers define at least one transmission mechanism that is acoustically coupled to the single MEMS transducer to enable an audio input to pass to the single MEMS transducer.

In at least another embodiment, a MEMS microphone assembly is provided. The assembly includes a first enclosure, a single first (MEMS) transducer, a second enclosure a single second MEMS transducer, and a plurality of substrate layers. The single first MEMS transducer is positioned within the first enclosure. The single second MEMS transducer is positioned within the second enclosure. The plurality of substrate layers including a first substrate layer and a second substrate layer support the single first MEMS transducer and the single second MEMS transducer. The plurality of substrate layers define a first transmission mechanism to enable the single first MEMS transducer to receive an audio input signal and a second transmission mechanism to enable the second first MEMS transducer to receive the audio input signal

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The performance of MEMS type condenser microphones has improved rapidly and such microphones are gaining a larger market share from established electrets condenser microphones (ECM). One area in which MEMS microphone technology lags behind ECM is in the formation of gradient microphone structures. Such structures including ECM have, since the 1960's been used to form, far-field directional and near-field noise-canceling (or close-talking) microphone structures. A directional microphone allows spatial filtering to improve the signal-to-random incident ambient noise ratio, while noise-canceling microphones take advantage of a speaker's (or talker's) near-field directionality in addition to the fact that the gradient microphone is more sensitive to near-field speech than to far-field noise. The acoustical-gradient type of ECM as set forth herein uses a single microphone with two sound ports leading to opposite sides of its movable diaphragm. Thus, the sound signals from two distinct spatial points in the sound field are subtracted acoustically across a diaphragm of a single MEMS microphone. In contrast, an electrical-gradient based microphone system includes a two single port ECM that is used to receive sound at the two distinct spatial points, respectively. Once sound (e.g., an audio input signal) is received at the two distinct spatial points, then their outputs are subtracted electronically outside of the microphone elements themselves.

Unfortunately, a gradient type or based MEMS microphone (including directional and noise-canceling versions) have been limited to electrical-gradient technology. The embodiments disclosed herein provide for, but not limited to, an acoustical-gradient type MEMS microphone implementation. Further, the disclosure provided herein generally illustrates the manner in which an acoustical-gradient type MEMS microphone implementation can be achieved by, but not limited to, (i) providing a thin mechano-acoustical structure (e.g., outside of the single two port MEMS microphone) that is compatible with surface-mount manufacture technology and a thin form factor for small space constraint in consumer products (e.g., cell phone, laptops, etc.) and (ii) providing advantageous acoustical performance as will be illustrated herein.

Figure 1:
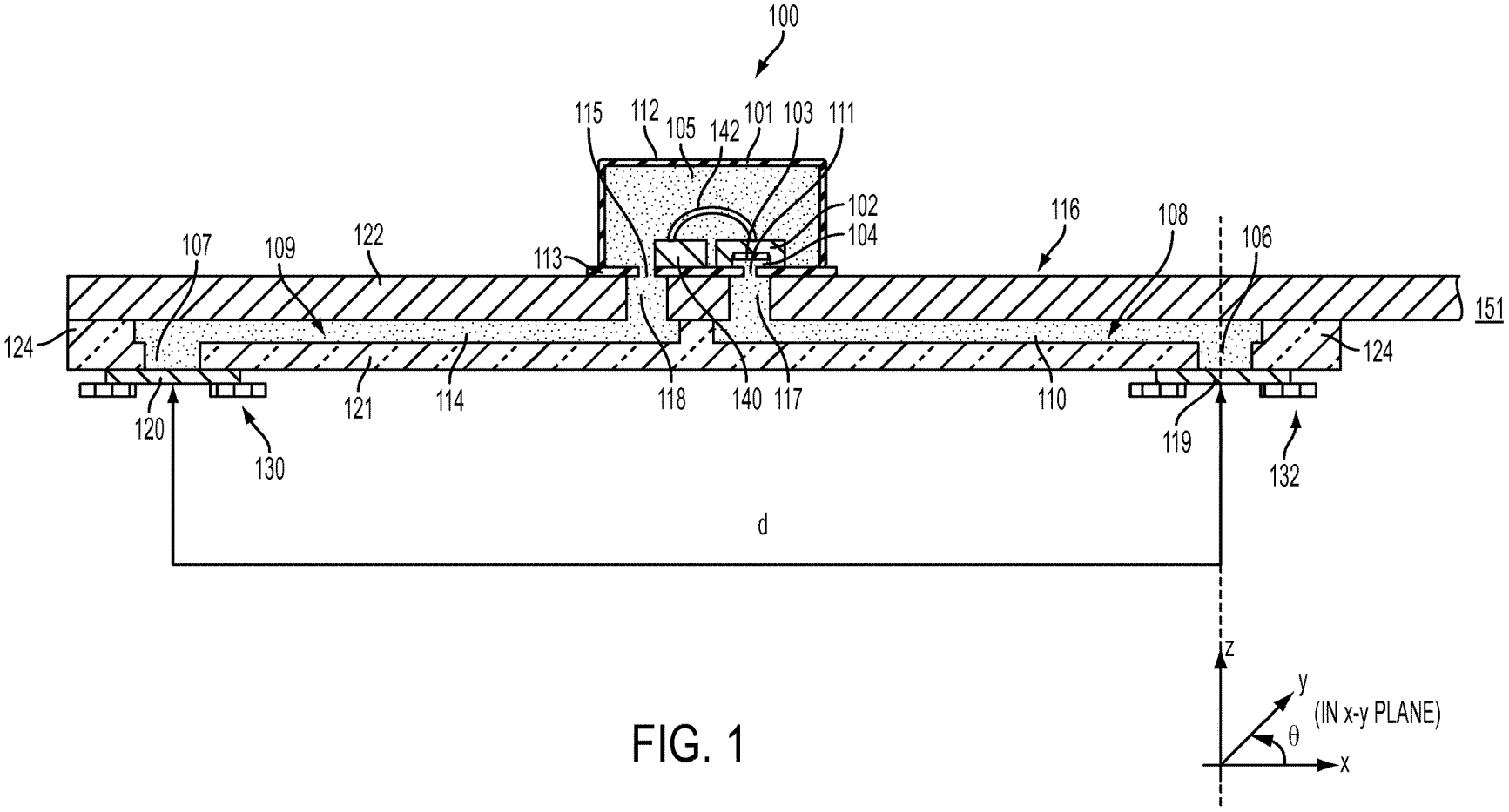
FIG. 1 depicts a cross sectional view of a gradient MEMS microphone assembly in accordance to one embodiment.

FIG. 1 depicts a cross sectional view of a gradient MEMS microphone assembly ("assembly") 100 in accordance to one embodiment. The assembly 100 includes a single MEMS microphone ("microphone") 101 including a single micro-machined MEMS die transducer ("transducer") 102 with a single moving diaphragm ("diaphragm") 103. It is recognized that a single transducer 102 may be provided with a multiple number of diaphragms 103. A microphone enclosure ("enclosure") 112 is positioned over the transducer 102 and optionally includes a base 113.

The base 113, when provided, defines a first acoustic port 111 and a second acoustic port 115. The first acoustic port 111 is positioned below the diaphragm 103. A first acoustic cavity 104 is formed between the base 113 and one side of the diaphragm 103. A second acoustic cavity 105 is formed at an opposite side of the diaphragm 103. The second acoustic port 115 abuts the second acoustic cavity 105. The diaphragm 103 is excited in response to an audio signal pressure gradient that is generated between the first and the second acoustic cavities 104, 105.

A plurality of substrate layers 116 supports the microphone 101. The plurality of substrate layers 116 include a first substrate layer 121 and a second substrate layer 122. In one example, the first substrate layer 121 may be a polymer such as PCABS or other similar material. The second structure layer 122 may be a printed circuit board (PCB) and directly abuts the enclosure 112 and/or the base 113. The second substrate layer 122 may also be a polyimide or other suitable material. The plurality of substrate layers 116 mechanically and electrically support the microphone 101 and enable the assembly 100 to form a standalone component for attachment to an end user assembly (not shown). The plurality of substrate layers 116 form or define a first transmission mechanism (generally shown at "108") and a second transmission mechanism (generally shown at "109"). The first transmission mechanism 108 generally includes a first sound aperture 106, a first acoustic tube 110, and a first acoustic hole 117. The second transmission mechanism 109 generally includes a second sound aperture 107, a second acoustic tube 114, and a second acoustic hole 118. An audio input signal (or sound) is generally received at the first sound aperture 106 and at the second sound aperture 107 and subsequently passed to the microphone 101. This will be discussed in more detail below.

The base 113 defines a first acoustic port 111 and a second acoustic port 115. As noted above, the base 113 may be optionally included in the microphone 101. If the base 113 is not included in the microphone 101, the first acoustic hole 117 may directly provide sound into the first acoustic cavity 104. In addition, the second acoustic hole 118 may directly provide sound into the second acoustic cavity 105.

The second substrate layer 122 is substantially planar to support the microphone 101. The first and the second acoustic tubes 110 and 114 extend longitudinally over the first substrate layer 121. The first sound aperture 106 is separated from the second sound aperture 107 at a delay distance d. The first and the second sound apertures 106 and 107, respectively, are generally perpendicular to the first and the second acoustic tubes 110 and 114, respectively. The first and the second acoustic holes 117, 118 are generally aligned with the first and the second acoustic ports 111 and 115, respectively.

A first acoustic resistance element 119 (e.g., cloth, sintered material, foam, micro-machined or laser drilled hole arrays, etc.) is placed on the first substrate layer 121 and about (e.g., across or within) the first sound aperture 106. A second acoustic resistance element 120 (e.g., cloth, sintered material, foam, micro-machined or laser drilled hole arrays, etc.) is placed on the first substrate layer 121 about (e.g., across or within) the second sound aperture 107. It is recognized that the first and/or second acoustic resistance elements 119 and 120 may be formed directly within the transducer 102 while the transducer 102 undergoes its micromachining process. Alternatively, the first and/or the second acoustic resistance elements 119 and 120 may be placed anywhere within the first and the second transmission mechanisms 108 and 109, respectively.

In general, at least one of the first and the second acoustic resistance elements 119, 120 are arranged to cause a time delay with the sound (or ambient sound) that is transmitted to the first sound aperture 106 and/or the second sound aperture 107 and to cause directivity (e.g., spatial filtering) of the assembly 100. In one example, the second acoustic resistance element 120 includes a resistance that is greater than three times the resistance of the first acoustic resistance element 119. In addition, the second acoustic cavity 105 may be three times larger than the first acoustic cavity 104.

In general, the first and the second acoustic resistance elements 119, 120 are formed based on the size restrictions of the acoustical features such as apertures, holes, or tube cross-sections of the first and the second transmission mechanisms 108 and 109. The first transmission mechanism 108 enables sound to enter into the microphone 101 (e.g., into the first acoustic cavity 104 on one side of the diaphragm 103). The second transmission mechanism 109 and the second acoustic port 115 (if the base 113 is provided) enable the sound to enter into the microphone 101 (e.g., into the second acoustic cavity 105 on one side of the diaphragm 103). In general, the microphone 101 (e.g., acoustic gradient microphone) receives the sound from a sound source and such a sound is routed to opposing sides of the moveable diaphragm 103 with a delay in time with respect to when the sound is received. The diaphragm 103 is excited by the signal pressure gradient between the first acoustic cavity 104 and the second acoustic cavity 105.

The delay is generally formed by a combination of two physical aspects. First, for example, the acoustic sound (or wave) takes longer to reach one entry point (e.g., the second acoustic aperture 107) into the microphone 101 than another entry point (e.g., the second acoustic aperture 106) since the audio wave travels at a speed of sound in the first transmission mechanism 108 and the second transmission mechanism 109. This effect is governed by the spacing or the delay distance, d between the first sound aperture 106 and the second sound aperture 107 and an angle of the sound source, θ. In one example, the delay distance d may be 12.0 mm. Second, the acoustic delay created internally by a combination of resistances (e.g., resistance values of the first and the second acoustic resistance elements 119 and 120) and acoustic compliance (volumes) creates the desired phase difference across the diaphragm.

If the sound source is positioned to the right of the assembly 100, any sound generated therefrom will first reach the first sound aperture 106, and after some delay, the sound will enter into the second sound aperture 107 with an attendant relative phase delay in the sound thereof. Such a phase delay assists in enabling the microphone 101 to achieve desirable performance. As noted above, the first and the second sound apertures 106 and 107 are spaced at the delay distance "d". Thus, the first acoustic tube 110 and the second acoustic tube 114 are used to transmit the incoming sound to the first acoustic hole 117 and the second acoustic hole 118, respectively, and then on to the first acoustic port 111 and the second acoustic port 115, respectively.

In general, the sound or audio signal that enters from the second sound aperture 107 and subsequently into the second acoustic cavity 105 induces pressure on a back side of the diaphragm 103. Likewise, the audio signal that enters from the first sound aperture 106 and subsequently into the first acoustic cavity 104 induces pressure on a front side of the diaphragm 103. Thus, the net force and deflection of the diaphragm 103 is a function of the subtraction or "acoustical gradient" between the two pressures applied on the diaphragm 103. The transducer 102 is operably coupled to an ASIC 140 via wire bonds 142 or other suitable mechanism to provide an output indicative of the sound captured by the microphone 101. An electrical connection 144 (see FIGS. 3A-3B) is provided on the second substrate layer 122 to provide an electrical output from the microphone 101 via a connector 147 (see FIGS. 3A-3B) to an end user assembly 200 (see FIGS. 3A-3B). This aspect will be discussed in more detail in connection with FIGS. 3A-3B. The plurality of substrate layers include a shared electrical connection 151 which enable the first substrate layer 121 and the second substrate layer 122 to electrically communicate with one another and to electrically communicate with the end user assembly 200.

In general, the assembly 100 may be a stand-alone component that is surface mountable on an end-user assembly. Alternatively, a first coupling layer 130 and a second coupling layer 132 (e.g., each a gasket and/or adhesive layer) may be used to couple the assembly 100 to the end user assembly 200. The second substrate layer 122 extends outwardly to enable other electrical or MEMS components to be provided thereon. It is recognized that the base 113 may be eliminated and that the ASIC 140 and transducer 102 (e.g., their respective die(s)) may be bonded directly to the second substrate layer 122. In this case, the first acoustic port 111 and the second acoustic port 115 no longer exist. Of course, other arrangements are feasible, such as the first sound aperture 106 being led directly to the first acoustic cavity 104 and the second sound aperture 107 being led directly into the second acoustic cavity 105. Additionally, the transducer 102 may be inverted and bump bonded directly to the base 113 or to the second substrate layer 122.

It may be desirable to form a "far field" directional type microphone where the audio source or talker is, for example, farther than 0.25 meters from the first sound aperture 106. In this case, it may be desirable to point a pickup sensitivity beam (polar pattern) toward the talker's general direction, but discriminate against the pickup of noise and room reverberation coming from other directions (e.g., from the left or behind the microphone). The second acoustic resistance element 120 (e.g., the larger resistance value) is placed into the plurality of substrate layers 116, and forms, for example, a cardioid polar directionality (see FIG. 5) instead of a bi-directional polar directivity, otherwise.

The appropriate level of acoustic resistance (e.g., Rs), used for the second acoustic resistance 120, depends on the desired polar shape, the delay distance d, and on the combined air volumes (acoustic compliance, Ca) of the second acoustic tube 114, the second acoustic hole 118, the second acoustic port 115 and the second acoustic cavity 105. The second acoustic tube 114 adds a significant air volume that augments the volume of the second acoustic cavity 105. Thus, for a given acoustic resistance value and the delay distance d, such a condition decreases the need to configure the second acoustic cavity 105 and hence the microphone 101 to be larger. Of course, the second acoustic tube 114 enables in achieving the large delay distance "d" as needed above. It should be noted that the first acoustic resistance element 119 may be omitted or included. The acoustic resistance for the first acoustic resistance element 119 may be smaller than that of the second acoustic resistance element 120 and may be used to prevent debris and moisture intrusion or mitigate wind disturbances. The resistance value of Rs for the second acoustic resistance element 120 is generally proportional to d/Ca. In general, the acoustical compliance is a volume or cavity of air that forms a gas spring with equivalent stiffness, and whereas its acoustical compliance is the inverse of its acoustical stiffness.

It should be noted that electroacoustic sensitivity is proportional to the delay distance d and hence a larger d means higher acoustical signal-to-noise ratio (SNR), which is a strong factor to the directional microphone due to the distant talker or speaker. Thus, in the assembly 100, the enhancement of SNR is enabled due to the first and second acoustic tubes 110 and 114 which allow for a large "d", while achieving the originally desired polar directionality that is needed in customer applications.

The assembly 100 may support near field (<0.25 meters) capability with a smaller delay distance "d" and still achieve high levels of acoustic noise canceling. While the gradient noise-canceling acoustic sensitivity of the microphone 101 and hence acoustical signal-to-noise ratio (SNR) will decrease, this is generally not a concern as the speaker is close.

The assembly 100 as set forth herein not only provides high levels of directionality or noise canceling, but a high SNR when needed. Further, the assembly 100 yields a relatively flat and wide-bandwidth frequency response which is quite surprising given the long length of the first and second acoustic tube 110 and 114. The assembly 100 may be either SMT bonded within, or SMT bonded or connected to an end-used board or housing which may be external to the assembly 100.

In general, it should be noted that "air volumes" or "acoustic cavities" are positioned proximate to the diaphragm 103 to allow motion thereof. These acoustic cavities can take varied shapes and be formed within (i) portions of the second acoustic cavity 105 in the enclosure 112, (ii) the first acoustic cavity 104 in the transducer 102, or (iii) the first and the second transmission mechanisms 108 and 109 when the second substrate layer 122 is formed.

It is recognized that the first and the second transmission mechanism 108 or 109 and the first and second acoustic tubes 110 or 114 may also utilize a multiplicity of acoustically parallel tubes or holes or ports with the same origin and terminal points, for example, a bifurcated tube. Moreover, such a parallel transmission implementation of tubes could have a single origin, but multiple terminal points. For example, a single "first tube" leading from the microphone 101 to the first sound aperture 106 could be replaced by parallel tubes leading from the same origin point at the microphone 101 to a multiplicity of separated first sound apertures 106.

It is also recognized that to further enhance the effective delay distance, d between the first and the second sound apertures 106, 107 when the assembly 100 is mated to the ported end-user housing, physical baffles (not shown) may be placed on an exterior of the end user housing between the two ports so as to increase the traveling wave distance between the two ports.

It also recognized that while the assembly 100 provides two acoustical transmission lines leading to two substantially separated sound apertures thus forming a first-order gradient microphone system, similar structures may be used to form higher-order gradient microphone system with a greater number of transmission lines and sound apertures.

Figure 2:
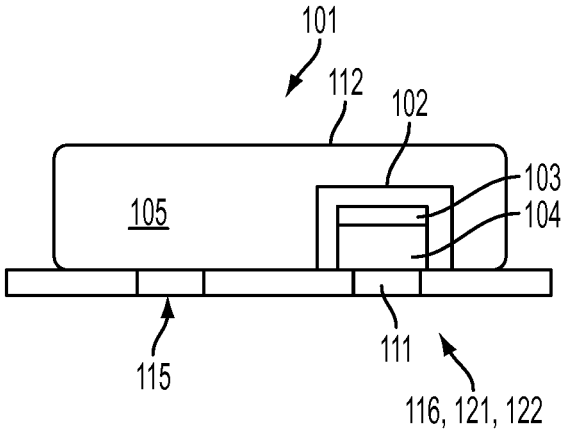
FIG. 2 depicts a microphone of FIG. 1 in accordance to one embodiment.

FIG. 2 depicts the microphone 101 of FIG. 1 in accordance to one embodiment. In general, the microphone 101 is a base element MEMS microphone that includes a microphone die with at least two ports (e.g., first and second acoustic ports 111 and 115) to allow sound to impinge on a front (or top) and a back (or bottom) of the diaphragm 103.

Figure 3A:
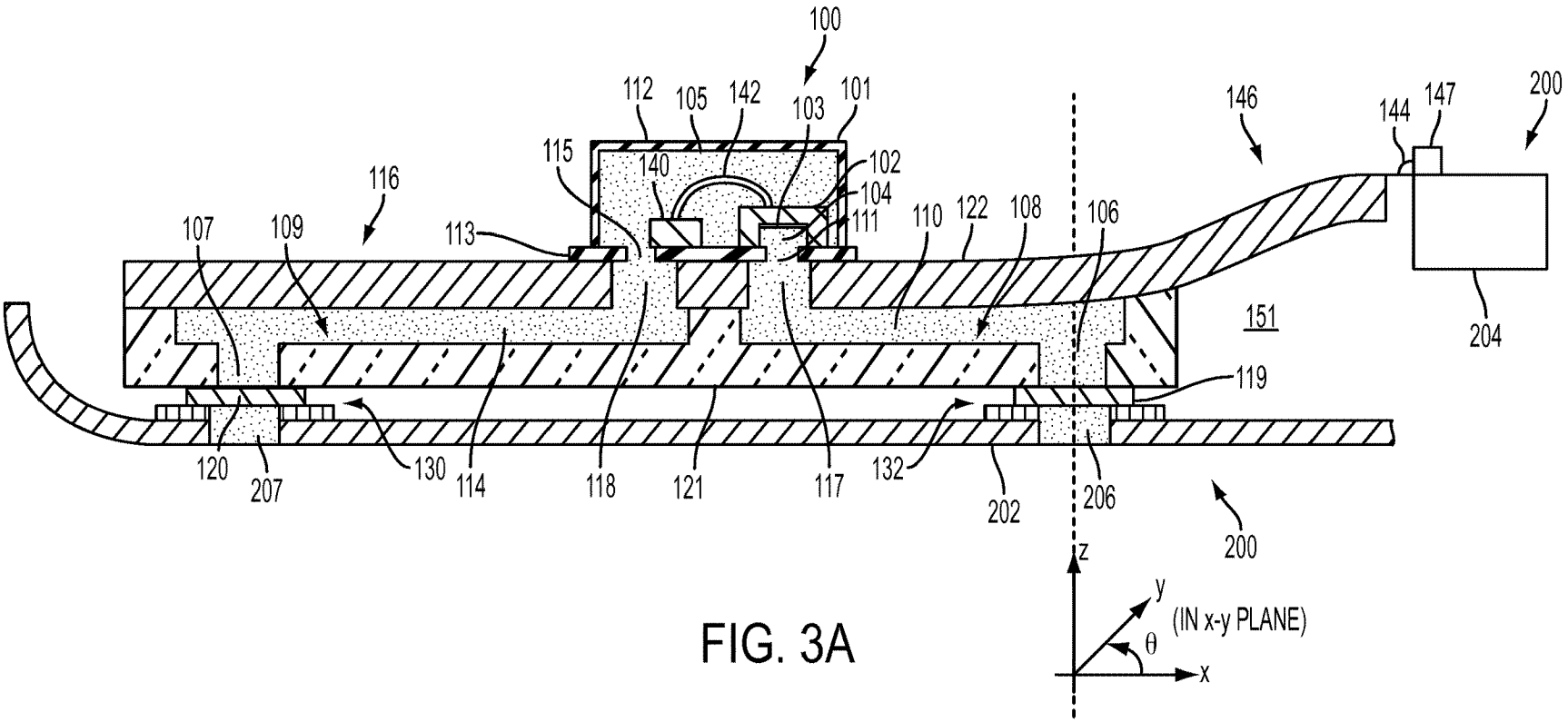
FIGS. 3A-3B depict the microphone assembly as coupled to an end-user assembly in accordance to various embodiments.
Figure 3B:
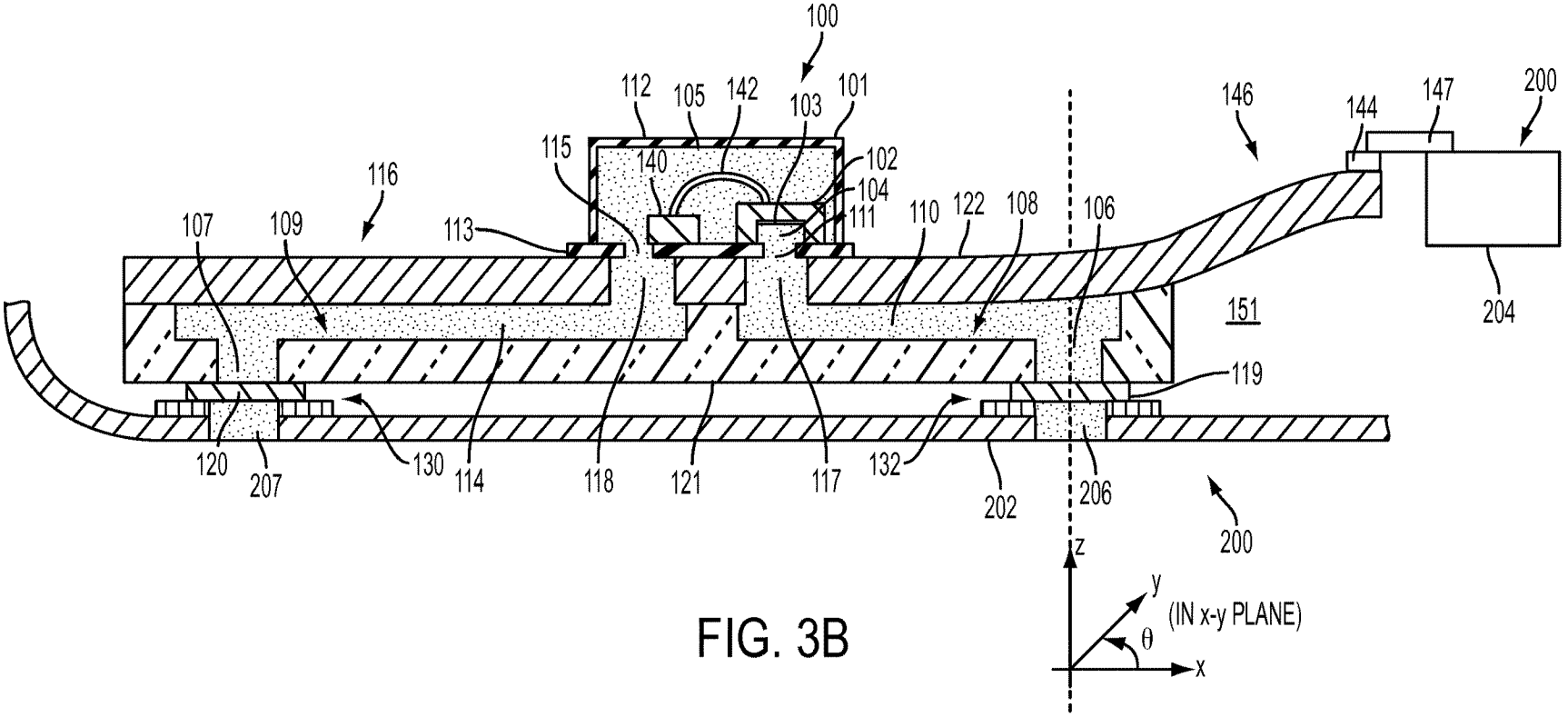

FIGS. 3*a*-3*b* depict the microphone assembly 100 as coupled to an end user assembly 200. The end user assembly 200 includes an end user housing 202 and an end user circuit board 204. In one example the end user assembly 200 may be a cellular phone, speaker phone or other suitable device that requires a microphone for receiving audio data. The end user housing 202 may be a portion of a handset or housing of the speaker phone, etc. The end user housing 202 defines a first user port 206 and a second user port 207 that is aligned with the first sound aperture 106 and the second sound aperture 107, respectively. The sound initially passes through the first user port 206 and the second user port 207 and into the first transmission mechanism 108 and the second transmission mechanism 109, respectively, and subsequently into the microphone 101 as described above.

As shown, the microphone assembly 100 may be a standalone product that is coupled to the end user assembly 200. The first coupling layer 130 and the second coupling layer 132 couple the microphone assembly 100 to the end user assembly 200. In addition, the first coupling layer 130 and the second coupling layer 132 are configured to acoustically seal the interface between the microphone assembly 100 and the end user assembly 200. The second substrate layer 122 includes a flexible board portion 146. The flexible board portion 146 is configured to flex in any particular orientation to provide the electrical connection 144 (e.g., wires) and a connector 147 to the end user circuit board 204. It is recognized that the electrical connection 144 need not include wires for electrically coupling the microphone 101 to the end user circuit board 204. For example, the electrical connection 144 may be an electrical contact that is connected directly with the connector 147. The connector 147 is then mated directly to the end user circuit board 204. This aspect is depicted in FIG. 3B. It is also recognized that any microphone assembly as described herein may or may not include the flexible board portion 146 for providing an electrical interface to the end user circuit board 204. This condition applies to any embodiment as provided herein.

Figure 4:
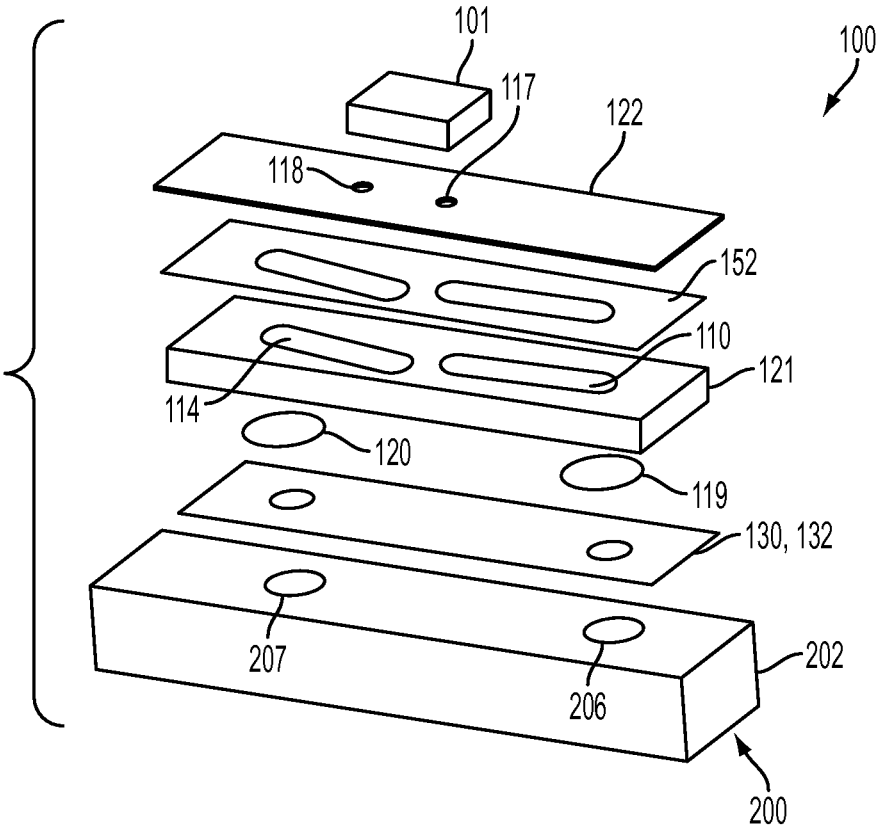
FIG. 4 depicts an exploded view of the microphone assembly and a portion of the end-user assembly in accordance to one embodiment.

FIG. 4 depicts an exploded view of the microphone assembly 100 in addition to the end user housing 202 of the end user assembly 200 in accordance to one embodiment. A first acoustic seal 152 (not shown in FIGS. 1 and 3) is positioned over the first substrate layer 121 to prevent the sound from leaking from the first acoustic tube 110 and the second acoustic tube 114. The end user housing 202 is provided to be coupled with the microphone assembly 100.

Figure 5:
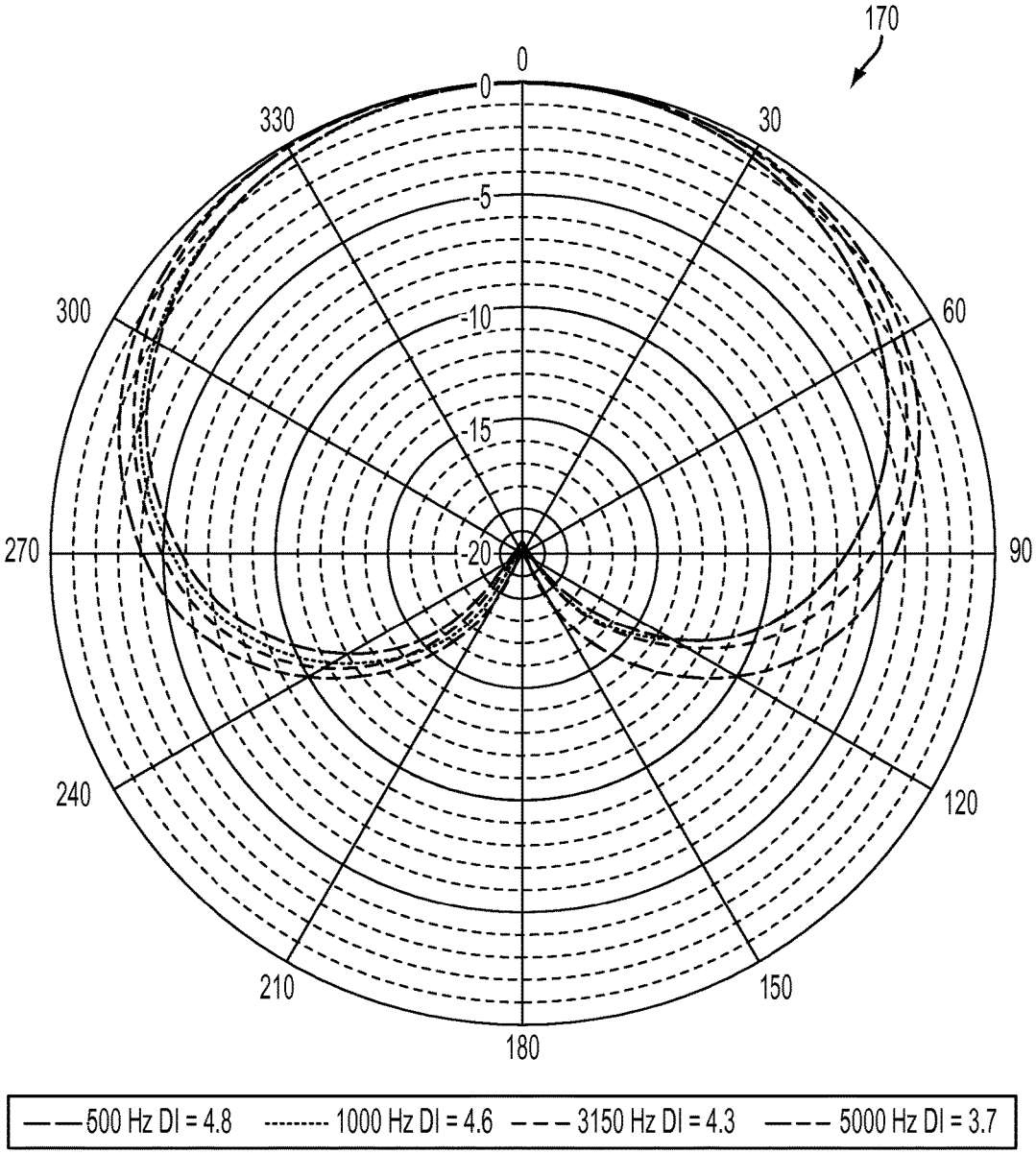
FIG. 5 depicts one example of spatial filtering attributed to the microphone assembly of FIG. 1.

FIG. 5 is a plot 170 that illustrates one example of polar directivity or spatial filtering attributed to the microphone 101 (or assembly 100) as noted above in connection with FIG. 1. FIG. 5 generally represents a free field 1 meter microphone measurement polar directivity response.

Figure 6:
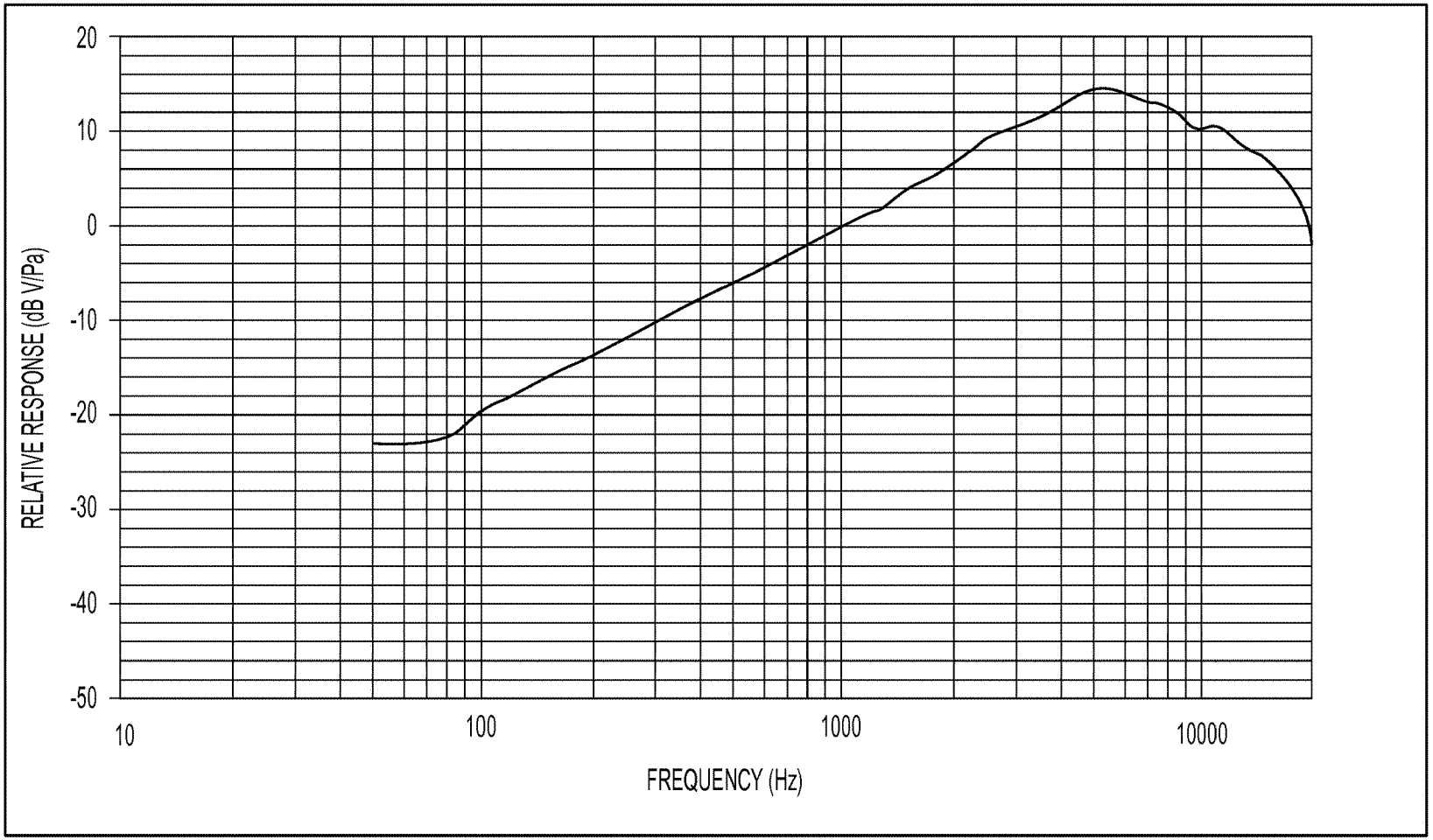
FIG. 6 depicts one example of frequency response of the microphone assembly as set forth in FIG. 1 in accordance to one embodiment.

FIG. 6 depicts an example of a simulated frequency response shape of the microphone assembly 100 as set forth in FIG. 1 in accordance to one embodiment. In particular, the FIG. 6 is a plot of the ration in dB of the electrical output from the ASIC 140 to the acoustical input to the first sound aperture 106 versus the frequency.

Figure 7:
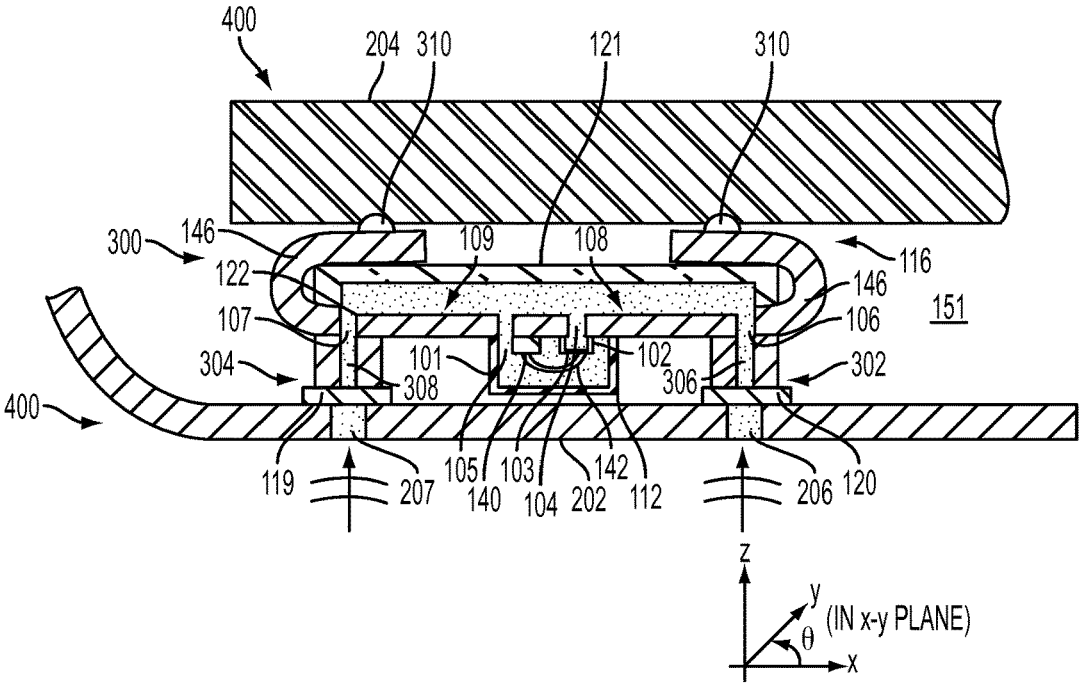
FIG. 7 depicts another cross-sectional view of a gradient MEMS microphone assembly as coupled to another end-user assembly in accordance to one embodiment.

FIG. 7 depicts another cross-sectional view of a gradient MEMS microphone assembly 300 as coupled to another end user assembly 400. In general, the microphone assembly 300 may be implemented as a surface mountable standalone package that is reflow soldered on the end user circuit board 204. The microphone assembly 300 includes a first extended substrate 302 and a second extended substrate 304 that acoustically couples the microphone 101 to the end user housing 202 for receiving sound from a speaker (or talker). For example, the first extended substrate 302 defines a first extended channel 306 for receiving sound from the first user port 206. The sound is then passed into the first transmission mechanism 108 and subsequently into the first acoustic cavity 104 of the microphone 101. The second extended substrate 304 defines a second extended channel 308 for receiving sound from the second user port 207. The sound is then passed into the second transmission mechanism 109 and subsequently into the second acoustic cavity 105 of the microphone 101.

It is recognized that the first acoustic resistance element 119 may be placed at any location about the first transmission mechanisms 108. The second acoustic resistance element 120 may optionally be placed anywhere along the second transmission mechanism 109. Additionally, the first and the second acoustic resistance elements 119, 120 may optionally be placed anywhere along the first and the second user ports 206 and 207. This condition applies to any embodiment as provided herein. The first coupling layer 130 may be placed at the interface of the second substrate layer 122 and the first extended substrate 302 and at the interface of the first extended substrate 302 and the end user housing 202. The second coupling layer 132 may be placed at the interface of the second substrate layer 122 and the second extended substrate 304 and at the interface of the second extended substrate 304 and the end user housing 202. As shown, the flexible board portion 146 is provided at two locations to form an electrical connection 310 with the end user circuit board 204. The electrical connection 310 may comprise a surface mount technology (SMT) electrical connection.

Figure 8:
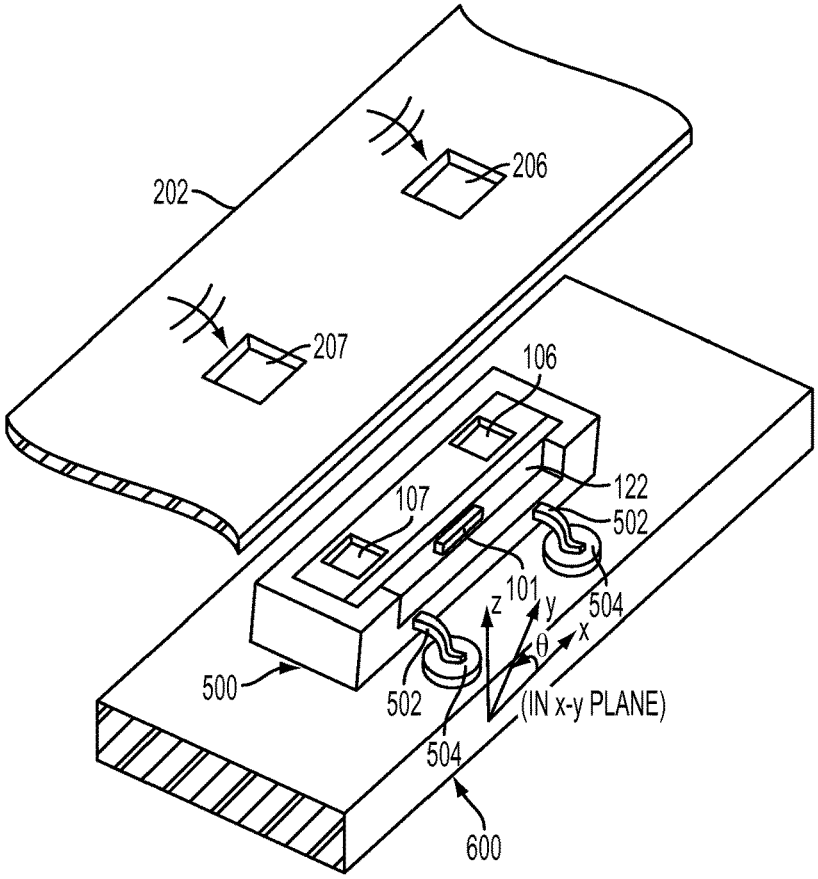
FIG. 8 depicts another cross-sectional view of a gradient MEMS microphone assembly in accordance to one embodiment.

FIG. 8 depicts another view of a gradient MEMS microphone assembly 500 as coupled to another end user assembly 600. The microphone assembly 500 may also be implemented as a surface mountable standalone package that is reflow soldered on the end user circuit board 204. The microphone assembly 500 includes a plurality of electrical legs 502 that protrude therefrom for being reflowed soldered to contacts 504 on the end user circuit board 204. In general, the microphone assembly 500 may include any number of the features as disclosed herein. It is also recognized that the microphone assembly 500 may include the first and the second resistance elements 119 and 120. Additionally, the first and the second coupling layers 130, 132 may be provided at the interface between the first and the second sound apertures 106, 107 and the first and the second user ports 206, 207.

Figure 9:
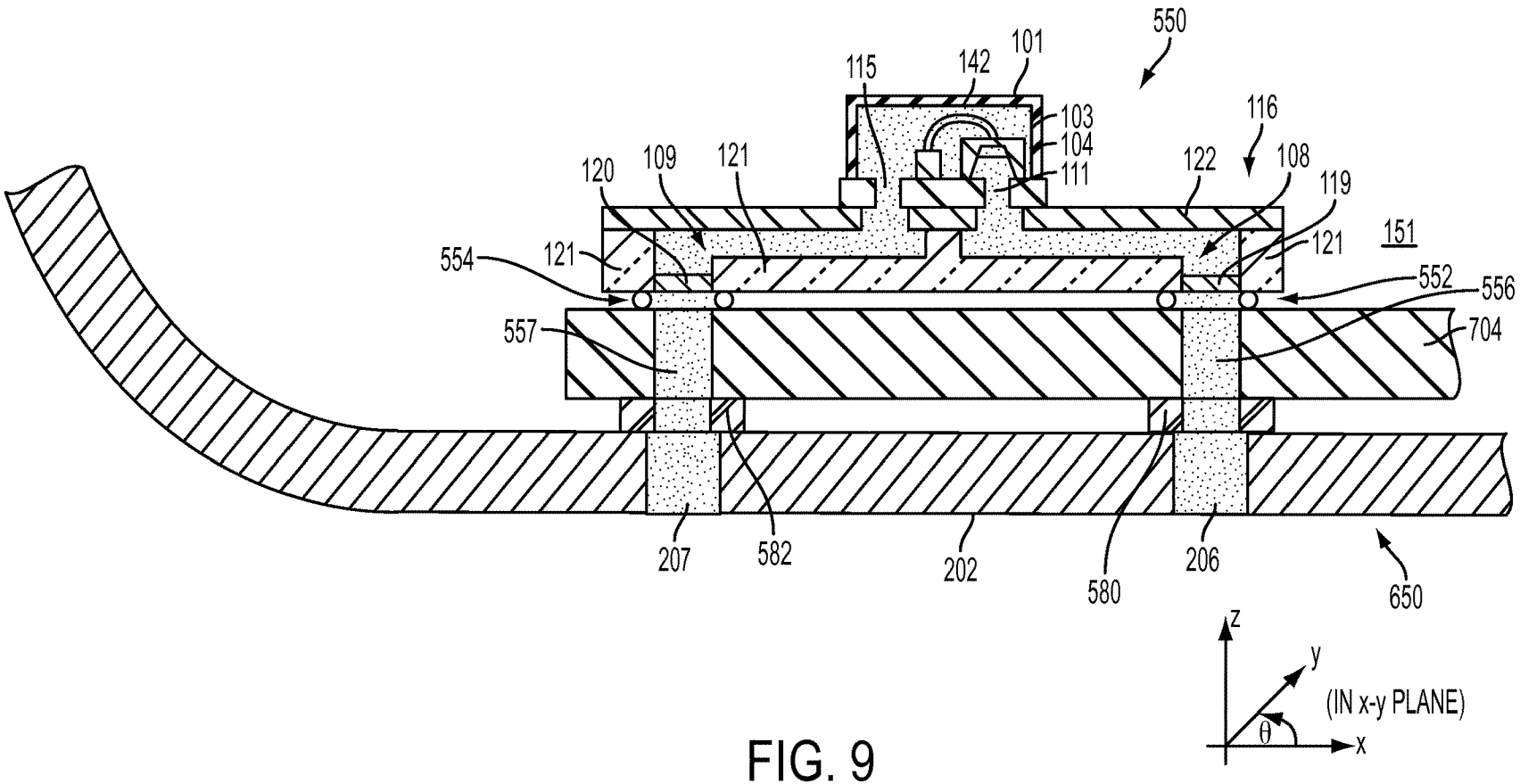
FIG. 9 depicts another cross-sectional view of a gradient MEMS microphone assembly in accordance to one embodiment

FIG. 9 depicts another cross-sectional view of a gradient MEMS microphone assembly 550 as coupled to another end user assembly 650. In general, the assembly 550 (e.g., the first substrate layer 121) may be electrically coupled to the end user circuit board 204 via surface mount contacts 552 and 554 (e.g., the assembly 550 is surface mounted to the end user circuit board 204). The end user circuit board 204 defines a first board channel 556 and a second board channel 557. The first board channel 556 and the second board channel 557 of the end user circuit board 204 are aligned with the first sound aperture 106 and the second sound aperture 107 in addition to the first user port 206 and the second user port 207 such that each of the assembly 550, the end user circuit board 204 and the end user housing 202 enable acoustic communication therebetween. First and second coupling layers 580 and 582 are provided to mechanically couple the end user circuit board 204 to the end user housing 202. Further, the first and the second coupling layers 580 and 582 acoustically seal the interface between the end user circuit board 204 and the end user housing 202.

Figure 10:
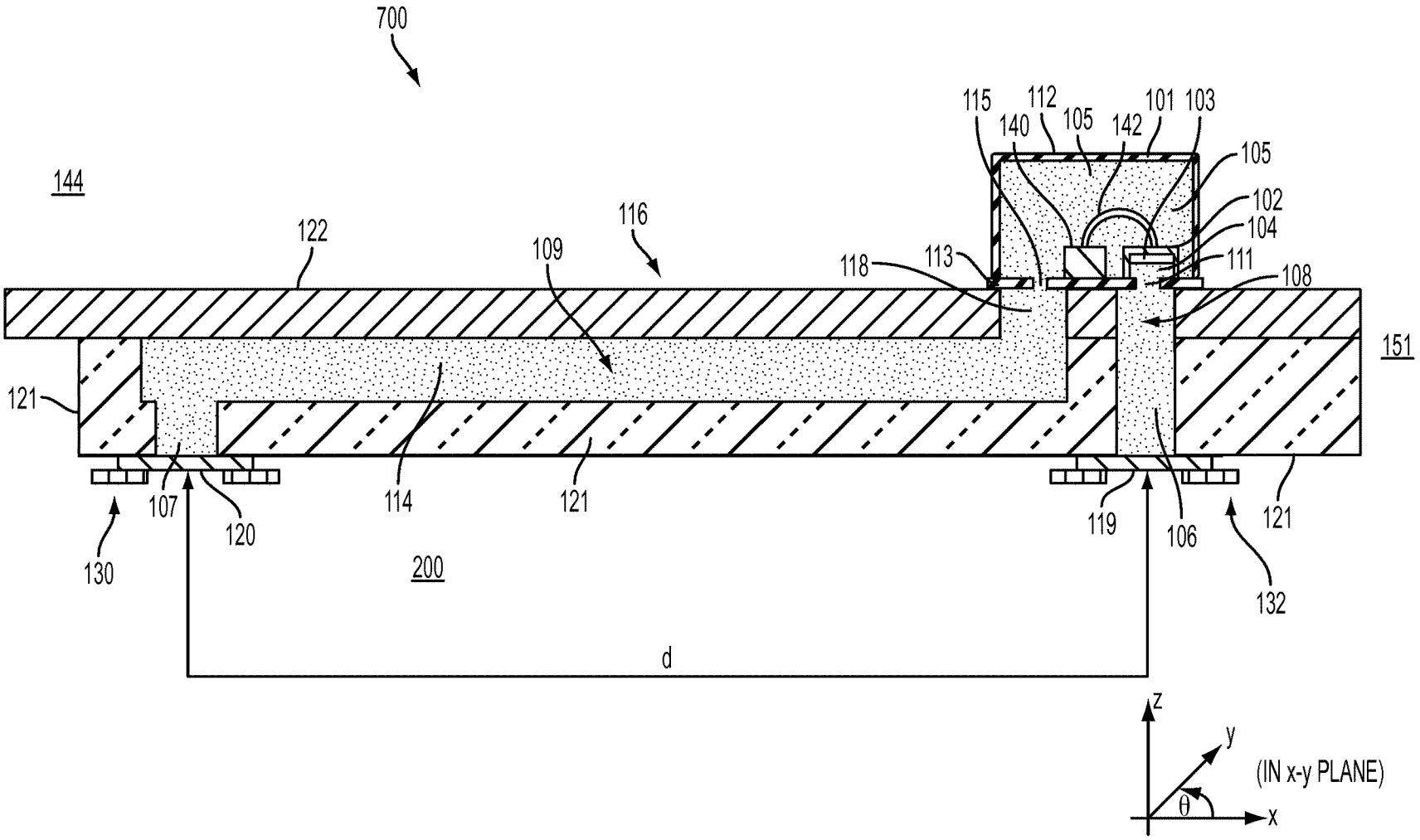
FIG. 10 depicts another cross-sectional view of a gradient MEMS microphone assembly in accordance to one embodiment.

FIG. 10 depicts a cross-sectional view of another gradient MEMS microphone assembly 700 in accordance to one embodiment. As shown, the first sound aperture 106 is directly coupled to the first acoustic port 111. In this case, the first transmission mechanism 108 includes the first sound aperture 106 and the first acoustic port 111, while the second transmission mechanism 109 includes the second sound aperture 107, the second acoustic tube 114, and the second acoustic hole 118. This differs from the microphone assemblies noted above as the first acoustic tube 110 and the first acoustic hole 117 is not provided in the first transmission mechanism 108 of the assembly 700. It is recognized that the first transmission mechanism 108 and the second transmission mechanism 109 is still separated by a delay distance, d. The delay distance however as illustrated in connection with the assembly 700 may not be as large as the delay distance, d used in connection with the other embodiments as disclosed herein. This condition may create a small amount of degradation of the high frequency response for the assembly 700.

Figure 11:
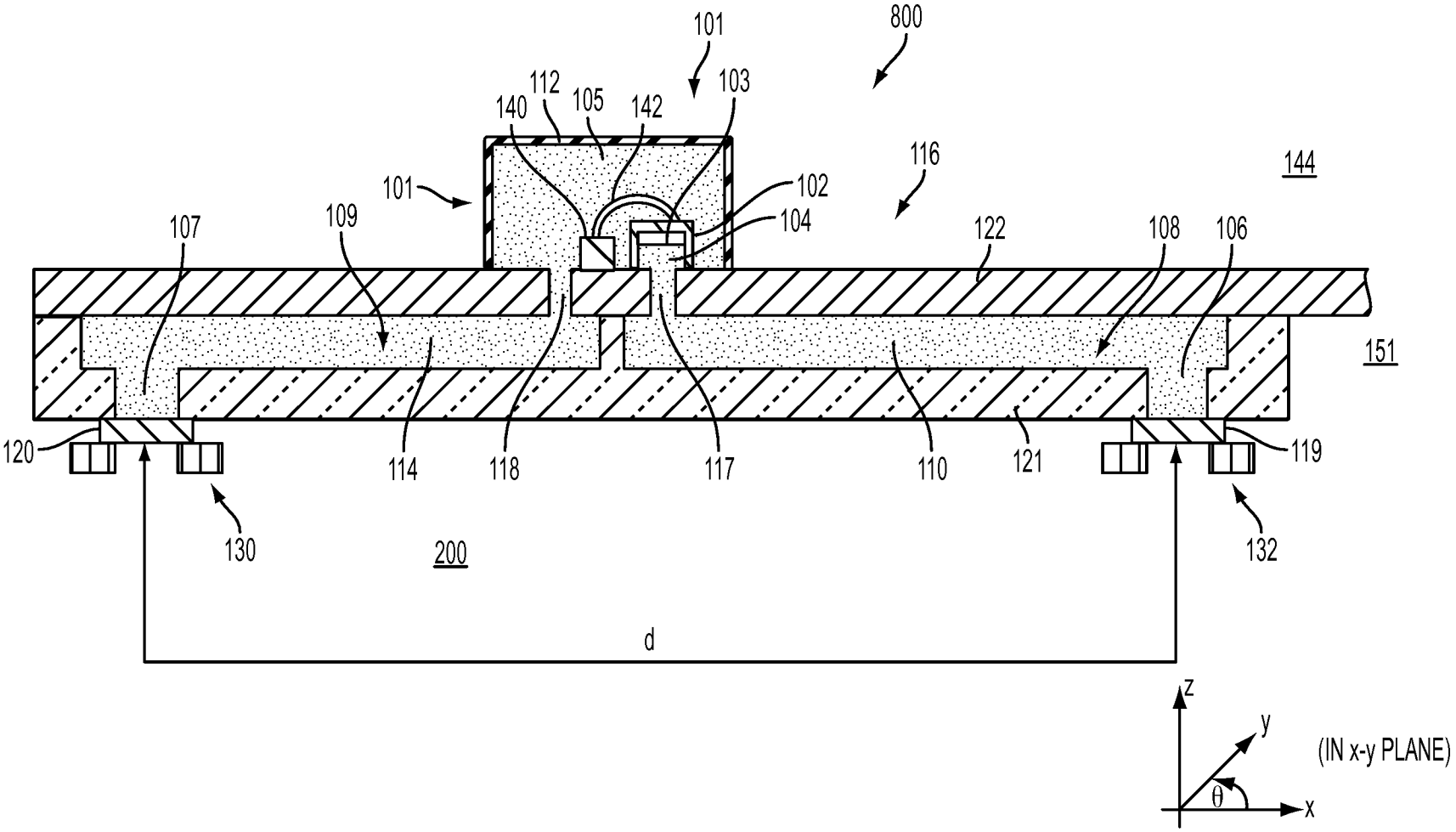
FIG. 11 depicts another cross-sectional view of another gradient MEMS microphone assembly in accordance to one embodiment.

FIG. 11 depicts a cross-sectional view of another gradient MEMS microphone assembly 800 in accordance to one embodiment. As shown, the enclosure 112 is directly attached to the second substrate structure layer 122 (i.e., the base 113 is removed (see FIG. 1 for comparison)). Additionally, the first acoustic port 111 and the second acoustic port 115 are removed (see FIG. 1 for comparison). Accordingly, a sound wave that enters into the first sound aperture 106 will travel into the first acoustic tube 110 and into the first acoustic hole 117. The sound wave also enters directly into the first acoustic cavity 104 which induces pressure on the front side of the diaphragm 103. Likewise, the sound wave will travel the delay distance, d and enter into the second sound aperture 107 and further travel into the second acoustic tube 114. The sound wave will enter into the second acoustic hole 118 and subsequently into the second acoustic cavity 105 which induces pressure on the rear side of the diaphragm 103. As noted above, the net force and deflection of the diaphragm 103 is a function of the subtraction or "acoustical gradient" between the two pressures applied on the diaphragm 103. The microphone 101 produces an electrical output that is indicative of the sound wave.

Figure 12:
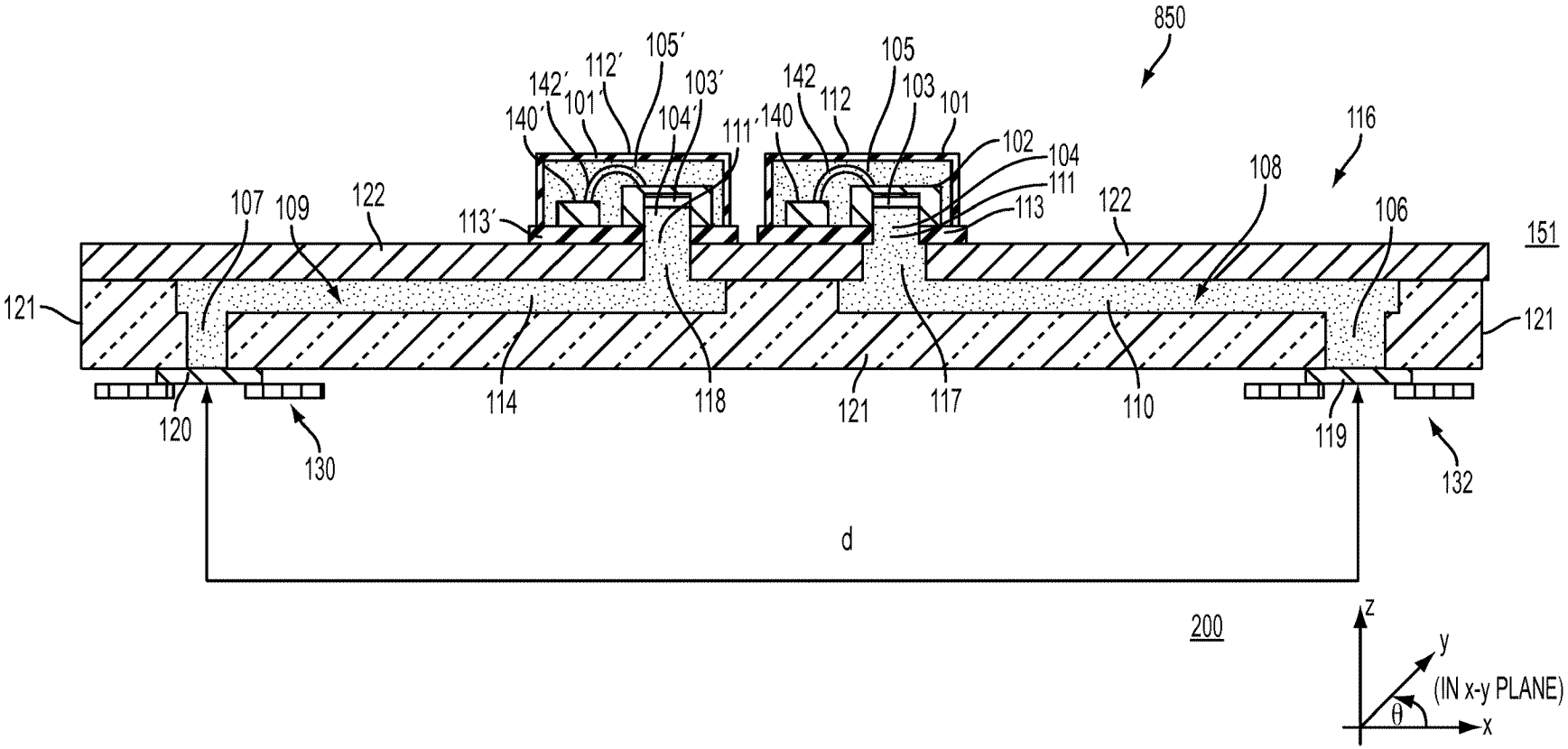
FIG. 12 depicts another cross-sectional view of an electrical-gradient MEMS based microphone assembly in accordance to one embodiment.

FIG. 12 depicts a cross-sectional view of an electrical-gradient MEMS microphone assembly 850 in accordance to one embodiment. The assembly includes the microphone 101 and a microphone 101'. The microphone 101' includes a transducer 102', a diaphragm 103', a first acoustic cavity 104', a first acoustic port 111', an enclosure 112', and a base 113'. As shown, the sound wave that enters into the second sound aperture 107 travels through the second acoustic tube 114 and through the second acoustic hole 118. From there, the sound wave travels through the first acoustic port 111' and into the first acoustic cavity 104' toward the front of the diaphragm 103'. In general, each diaphragm 103 and 103' experiences pressure from the incoming sound wave thereby enabling each microphone 101 and 101' to generate an electrical output indicative of the incoming sound wave. The electrical outputs are subtracted from each other outside in another integrated circuit that is positioned outside of the assembly 850. Alternatively, one of the microphones 101 or 101' may provide an electrical output that is conveyed to (via circuit traces within the second substrate layer 122) to the other microphone 101 or 101' for the subtraction operation as noted above to be executed. As shown, the assembly 850 in response to receiving sound at the two distinct spatial points, electronically subtracts the outputs from microphone elements 101 and 101'. This differs from the assemblies 100, 700 and 800 as such assembles require a pressure differential of the sound wave to be present across the diaphragm 103.

Figure 13:
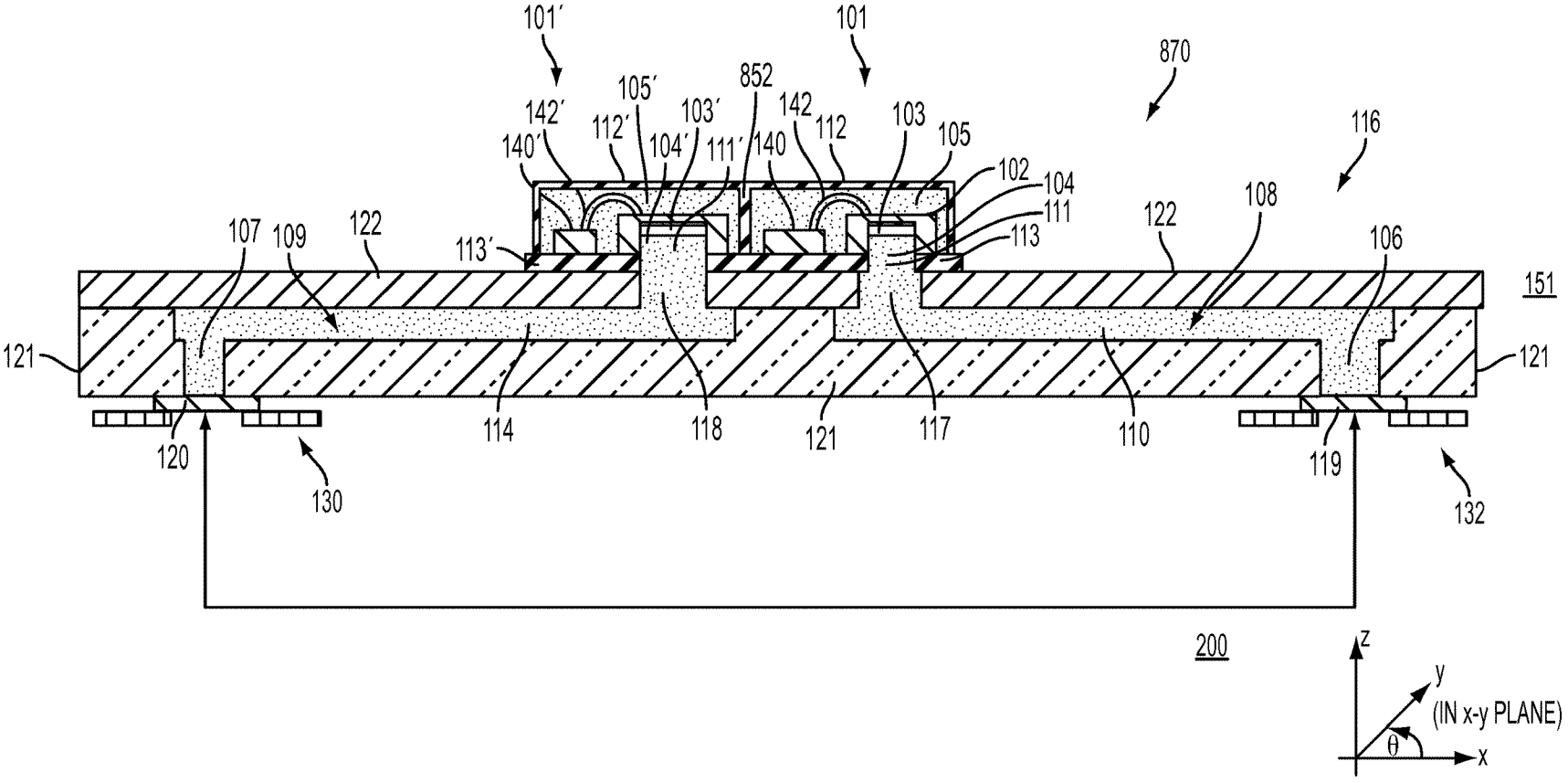
FIG. 13 depicts another cross-sectional view of an electrical-gradient MEMS based microphone assembly in accordance to one embodiment.

FIG. 13 depicts a cross-sectional view of an electrical gradient MEMS microphone 870 in accordance to another embodiment. The microphone assembly 870 is generally similar to the microphone assembly 850. However, the enclosures 112 and 112' are coupled together via a dividing wall 852. The dividing wall 852 may be solid or include apertures (or be mechanically compliant) to enable acoustical transmission between the microphones 101 and 101' at certain frequencies. Such acoustical transmission can be used to provide advantageous combined microphone performance in sensitivity, polar directivity, signal-to-noise ratio (SNR), and/or frequency response and bandwidth. This implementation may provide cost savings in comparison to the assembly 850 of FIG. 11. For example, a single housing may be formed and include the enclosure 112 and 112'. It is recognized that while multiple ASICs 140 and 140' are illustrated, a single ASIC may be provided for both microphones 101 and 101'. Each of the foregoing aspects may reduce cost associated with assembling the assembly 850.

It is recognized that while two acoustical transmission mechanisms 108 and 109 are provided which lead to two substantially separated sound apertures thus forming a first-order gradient microphone system, similar structures employing the concepts disclosed herein may be employed to form higher-order gradient microphone systems with a greater number of transmission mechanisms 108 and 109 and sound apertures 106 and 107.

It is further recognized that the first and the second transmission mechanisms 108 or 109 and the first and second acoustic tubes 110 and 114 may utilize a multiplicity of acoustically parallel apertures or tubes or holes or ports with the same origin and terminal points, for example a bifurcated tube. Moreover, such parallel transmission mechanisms, aperture, tubes, or hole may have a single origin but multiple terminal points. For example, a single "first tube" leading from the microphone 101 to a "first sound aperture" could be replaced by parallel tubes leading from the same origin point at the microphone 101 to a multiplicity of separated "first sound apertures."

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A micro-electro-mechanical systems (MEMS) microphone assembly comprising:

an enclosure;

a single micro-electro-mechanical systems (MEMS) transducer positioned within the enclosure; and a first substrate layer and a second substrate layer to support the single MEMS transducer wherein the first substrate layer and the second substrate layer define a first transmission mechanism to enable a first side of the single MEMS transducer to receive an audio input signal and a second transmission mechanism to enable a second side of the single MEMS transducer to receive the audio input signal, wherein the first substrate layer defines a first acoustic hole and a second acoustic hole extending through the first substrate layer wherein the second substrate layer defines a first sound aperture and a second sound aperture extending through the second substrate layer, wherein the first transmission mechanism includes a first acoustic tube, the first sound aperture, and the first acoustic hole, wherein each of the first sound aperture and the first acoustic hole are laterally offset from one another, wherein the first acoustic tube has a first longitudinal length that is greater than a longitudinal length of each of the first sound aperture and the first acoustic hole, wherein the second transmission mechanism includes a second acoustic tube, the second sound aperture, and the second acoustic hole, wherein each of the second sound aperture and the second acoustic hole are laterally offset from one another, wherein the second acoustic tube has a second longitudinal length that is greater than a longitudinal length of each of the second sound aperture and the second acoustic hole, wherein the first acoustic tube and the second acoustic tube extend longitudinally below the first substrate layer, wherein a delay distance separates the first sound aperture from the second sound aperture, and wherein the delay distance is longer than an overall length of the enclosure.

2. The microphone assembly of claim 1:

wherein the enclosure defines a first acoustic port and a second acoustic port;

wherein the first acoustic port is acoustically coupled to the first transmission mechanism to enable the first side of the single MEMS transducer to receive the audio input signal; and wherein the second acoustic port is acoustically coupled to the second transmission mechanism to enable the second side of the single MEMS transducer to receive the audio input signal.

3. The microphone assembly of claim 1 wherein the enclosure defines a first acoustic cavity on the first side of the single MEMS transducer and a second acoustic cavity on the second side of the single MEMS transducer, wherein the first transmission mechanism includes the first acoustic hole that is directly acoustically coupled with the first acoustic cavity; and wherein the second transmission mechanism includes the second acoustic hole that is directly acoustically coupled with the second acoustic cavity.

4. The microphone assembly of claim 1 wherein the first substrate layer is configured to electrically couple the single MEMS transducer to an end user circuit assembly.

5. The microphone assembly of claim 4 further including an electrical connector from the first substrate layer configured to electrically couple the single MEMS transducer to an end user circuit board of the end user circuit assembly.

6. The microphone assembly of claim 4 wherein the first substrate layer is configured to be surface mounted to an end user circuit board and the microphone assembly is a standalone package.

7. The microphone assembly of claim 4 wherein the first substrate layer includes a flexible portion.

8. The microphone assembly of claim 1 wherein the microphone assembly is formed of a surface mount technology (SMT) standalone package for being received on an end user circuit board.

9. The microphone assembly of claim 8 wherein the SMT standalone package includes a plurality of electrical legs configured to electrically communicate with a plurality of electrical contacts on the end user circuit board.

10. The microphone assembly of claim 1 wherein the first substrate layer and the second substrate layer include shared electrical routing configured to enable electrical communication with an end user circuit board.

11. The microphone assembly of claim 1 further comprising a first acoustic resistance element including a first resistance value positioned about the first transmission mechanism and a second acoustic resistance element including a second resistance value positioned about the second transmission mechanism.

12. The microphone assembly of claim 11 wherein the second resistance value is greater than three times the first resistance value.

13. The microphone assembly of claim 1 further comprising at least one coupling layer configured to couple the microphone assembly to an end user housing.

14. The microphone assembly of claim 1 wherein the first substrate layer includes a flexible portion to form an angle of at least ninety degrees for enabling the microphone assembly to be surface mount coupled to an end user circuit board.

15. The microphone assembly of claim 1 wherein the first acoustic tube and the second acoustic tube extend longitudinally below the first substrate layer and the single MEMS transducer.

16. The microphone assembly of claim 1 further comprising a first acoustic seal positioned between the first substrate layer and the second substrate layer to prevent the audio input signal from leaking from the first acoustic tube and the second acoustic tube.

17. The microphone assembly of claim 1 wherein the delay distance at least partly increases an amount of time the audio input signal enters into the first sound aperture as opposed to the second sound aperture.

18. A micro-electro-mechanical systems (MEMS) microphone assembly comprising:

an enclosure;

only one micro-electro-mechanical systems (MEMS) transducer positioned within the enclosure; and a plurality of substrate layers including a first substrate layer and a second substrate layer to support the only one MEMS transducer, wherein the first substrate layer is configured to electrically couple the only one MEMS transducer to an end user circuit board;

wherein the plurality of substrate layers define at least one transmission mechanism that is acoustically coupled to the only one MEMS transducer to enable an audio input signal to pass to the only one MEMS transducer;

wherein the first substrate layer defines a first acoustic hole and a second acoustic hole extending through the first substrate layer, wherein the second substrate layer defines a first sound aperture and a second sound aperture extending through the second substrate layer, wherein the at least one transmission mechanism includes a first transmission mechanism and a second transmission mechanism;

wherein the first transmission mechanism includes a first acoustic tube, the first sound aperture, and the first acoustic hole, wherein each of the first sound aperture and the first acoustic hole are laterally offset from one another, wherein the first acoustic tube has a first longitudinal length that is greater than a longitudinal length of the first sound aperture and the first acoustic hole, wherein each of the first sound aperture and the first acoustic hole are laterally offset from one another, wherein the second transmission mechanism includes a second acoustic tube, a second sound aperture, and the second acoustic hole, wherein the second acoustic tube has a second longitudinal length that is greater than a longitudinal length of each of the second sound aperture and the second acoustic hole, and wherein the first acoustic tube and the second acoustic tube extend longitudinally below the first substrate layer and the single only one MEMS transducer.

19. The microphone assembly of claim 18 wherein the first substrate layer includes an electrical connector that is configured to electrically couple the only one MEMS transducer to the end user circuit board.

20. The microphone assembly of claim 18 wherein the first substrate layer includes a flexible portion to form an angle of at least ninety degrees for enabling the microphone assembly to be surface mount coupled to the end user circuit board and wherein the microphone assembly is a standalone package.

21. The microphone assembly of claim 18 wherein the assembly is formed of a surface mount technology (SMT) standalone package for being received on an end user circuit board.

22. The microphone assembly of claim 21 wherein the SMT standalone package includes a plurality of electrical legs configured to electrically communicate with a plurality of electrical contacts on the end user circuit board.

23. The microphone assembly of claim 18 further comprising at least one coupling layer configured to couple the assembly to an end user housing.

24. The microphone assembly of claim 18 wherein the first substrate layer and the second substrate layer include shared electrical routing configured to enable electrical communication with the end user circuit board.

25. The microphone assembly of claim 18 wherein a delay distance separates the first sound aperture from the second sound aperture, and wherein the delay distance is longer than an overall length of the enclosure.

26. The microphone assembly of claim 25 wherein the delay distance at least partly increases an amount of time the audio input signal enters into the second sound aperture as opposed to the first sound aperture.

27. The microphone assembly of claim 18 further comprising a first acoustic seal positioned between the first substrate layer and the second substrate layer to prevent the audio input signal from leaking from the first acoustic tube and the second acoustic tube.

28. A micro-electro-mechanical systems (MEMS) microphone assembly comprising:

a first enclosure;

a single first micro-electro-mechanical systems (MEMS) transducer positioned within the first enclosure;

a second enclosure;

a single second MEMS transducer positioned within the second enclosure; and a plurality of substrate layers including a first substrate layer and a second substrate layer to support the single first MEMS transducer and the single second MEMS transducer, wherein the plurality of substrate layers define a first transmission mechanism to enable a bottom side of the single first MEMS transducer to receive an audio input signal and a second transmission mechanism to enable a bottom side of the single second MEMS transducer to receive the audio input signal, and wherein the first transmission mechanism and the second transmission mechanism are separate from one another, wherein the first transmission mechanism includes a first sound aperture, a first acoustic tube, and a first acoustic hole, wherein each of the first sound aperture and the first acoustic hole are laterally offset from one another, wherein the first acoustic tube has a first width that is greater than a width of the first sound aperture and the first acoustic hole, wherein the second transmission mechanism includes a second sound aperture, a second acoustic tube, and a second acoustic hole, wherein each of the second sound aperture and the second acoustic hole are laterally offset from one another, wherein the second acoustic tube has a second width that is greater than a width of the second sound aperture and the second acoustic hole, wherein first acoustic tube and the second acoustic tube extend longitudinally below the first substrate layer, wherein a delay distance separates the first sound aperture from the second sound aperture, and wherein the delay distance is longer than an overall length of the first enclosure and the second enclosure.

29. The microphone assembly of claim 28 wherein the plurality of substrate layers define the first sound aperture and the second sound aperture that are separated from one another by a predetermined distance.

30. The microphone assembly of claim 28 wherein the second substrate layer is configured to be attached to an end user housing to couple the single first MEMS transducer and the single second MEMS transducer to the end user housing.

31. The microphone assembly of claim 28 further comprising a dividing wall positioned between the first enclosure and the second enclosure to enable acoustic communication between the first enclosure and the second enclosure.

* * * * *